US007137514B1

(12) United States Patent
Nickipuck

(10) Patent No.: US 7,137,514 B1
(45) Date of Patent: Nov. 21, 2006

(54) STORAGE RAIL CONNECTORS FOR RATCHET WRENCH SOCKETS

(76) Inventor: Michael F. Nickipuck, 12158, Lake View Trail, Homer Glen, IL (US) 60491

( * ) Notice: Subject to any disclaimer, the term of this patent is extended or adjusted under 35 U.S.C. 154(b) by 144 days.

(21) Appl. No.: 10/656,045

(22) Filed: Sep. 5, 2003

Related U.S. Application Data

(60) Provisional application No. 60/408,649, filed on Sep. 6, 2002.

(51) Int. Cl.
*A47F 7/00* (2006.01)

(52) U.S. Cl. ..... 211/70.6

(58) Field of Classification Search ..... 211/70.6, 211/94.01; 206/378, 493, 806, 377, 372
See application file for complete search history.

(56) References Cited

U.S. PATENT DOCUMENTS

| | | | | |
|---|---|---|---|---|
| 4,480,511 | A | 11/1984 | Nickipuck | |
| 4,621,738 | A | 11/1986 | DeLucchi | |
| 4,768,405 | A | 9/1988 | Nickipuck | |
| 4,826,021 | A | 5/1989 | Burrell | |
| 4,938,107 | A | 7/1990 | Nickipuck | |
| 5,228,570 | A | 7/1993 | Robinson | |
| 5,398,823 | A | 3/1995 | Anders | |
| 5,467,874 | A | 11/1995 | Whitaker | |
| 5,649,621 | A | 7/1997 | Brody | |
| 5,715,951 | A | 2/1998 | Dembicks | |
| 5,855,284 | A | 1/1999 | Dembicks | |
| 6,092,655 | A * | 7/2000 | Ernst | 206/378 |
| 6,092,656 | A * | 7/2000 | Ernst | 206/378 |
| 6,168,018 | B1 | 1/2001 | Ramsey et al. | |
| 6,386,363 | B1 | 5/2002 | Huang | |
| 6,415,933 | B1 * | 7/2002 | Kao | 211/70.6 |
| 6,431,373 | B1 * | 8/2002 | Blick | 211/70.6 |
| 6,450,338 | B1 | 9/2002 | Chen | |
| 6,637,605 | B1 * | 10/2003 | Ernst | 211/70.6 |
| 6,712,225 | B1 * | 3/2004 | McNeely | 211/70.6 |

* cited by examiner

*Primary Examiner*—Jennifer E. Novosad
(74) *Attorney, Agent, or Firm*—Barnes & Thornburg LLP; David C. Brezina; Mark J. Nahnsen

(57) ABSTRACT

A wrench socket retaining and releasing storage apparatus has a body with a base, a shank and a square drive retaining end, slide key fitting in a channel positively locks the socket in place by displacing lock balls transversely, the slide key being manually releasable by action of a sleeve that moves the slide key against a lock spring thereby urging the slide key upward, with the lock spring also urging a rail engaging tension ball downward, this releasing enabling a tapered spiral ejector spring to both urge the socket off the end, and through the tightest, lower coil of the spring, retain the entire assembly together thereby enabling both firm and fixed storage and ease of removal.

17 Claims, 2 Drawing Sheets

STORAGE RAIL CONNECTORS FOR RATCHET WRENCH SOCKETS

This application claims priority from U.S. Provisional Application No. 60/408,649 filed Sep. 6, 2002.

BACKGROUND

This disclosure relates to a storage rail and individual storage connectors for ratchet wrench sockets which retain sockets using a wedge locking and releasing mechanism.

Ratchet socket wrenches are well known and socket wrenches and their accessories have significant advantages in strength, utility and efficiency for the mechanic, such as when compared to non-ratcheting wrenches such as open end or box end wrenches. Maximum utility in a socket wrench set inherently requires a plurality of sockets of different sizes. Indeed, the well equipped mechanic will have many different sizes and also multiple configurations, such as deep well sockets, six and twelve point sockets as well as English and Metric sizes.

Because of the multiplicity of sockets in a typical tool set, there is a need to store sockets in sets, in order and to have the sockets in an easy to locate and easy to inspect configuration.

Typical socket storage devices utilize an inverted "hat" section metal rail, with metal spring clips that capture the edges of the rail, and extend upwardly in a configuration that fits a socket's drive portion. The spring clips impose an imprecise, often large force that can make sockets difficult to remove, especially by a mechanic who may have grease, oil or other lubricant on the hands. Conversely, the spring material is also subject to bending, flexing and distortion which often undesirably permits the sockets to fall off at which time they may be lost, or under circumstances such as tools kept in a vehicle, can actually provide undesirably mobile objects in the vehicle.

Plastic equivalents, with retaining members carried on rails, have similar disadvantages of imprecise forces and wear induced looseness. Other plastic solutions have long posts to hold sockets in cylindrical recesses, or even magnets. Magnets provide additional disadvantages, including the unwanted magnetization of the sockets, as well as adverse results from use in the vicinity of electronics or magnetic media.

The wrench socket retaining and releasing storage apparatus uses a moving slide key to positively lock the socket in place, against an ejector spring, with manual release accomplished by manually actuating a release sleeve against a lock spring to move the slide key, thereby enabling both firm and fixed storage and ease of removal.

The operation of a control bar in a channel acting on retainer balls to hold a ratchet wrench socket on a socket wrench extension is taught in my U.S. Pat. No. 4,768,405, issued Sep. 6, 1988, U.S. Pat. No. 4,480,511, issued Nov. 6, 1984 and U.S. Pat. No. 4,938,107, issued Jul. 3, 1990, which patents are incorporated by reference as if fully set forth herein.

SUMMARY

The disclosure includes a wrench socket retaining and releasing storage apparatus that is comprised of a body with a base, a shank and a square drive retaining end. A slide key positively locks the socket in place by displacing lock balls transversely. A manually actuated release sleeve moves the slide key against a lock spring which both urges the slide key upward, and urges a rail engaging tension ball downward. A tapered spiral ejector spring both urges the socket off the end, and through the tightest, lower coil of the spring, provides for retaining the entire assembly together. This mechanism enables both firm and fixed storage and ease of removal.

DETAILED DESCRIPTION OF THE PREFERRED EMBODIMENT

Figure 1:
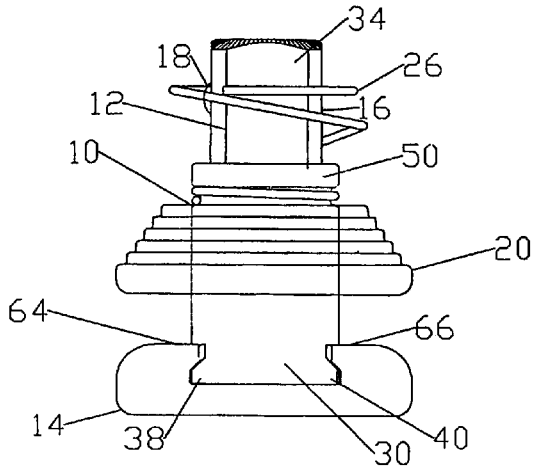
FIG. 1 is an end elevational view of the storage connector and rail of the invention.
Figure 2:
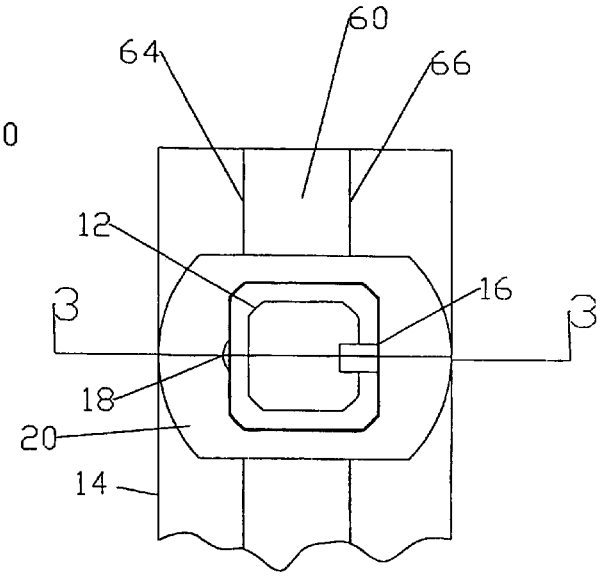
FIG. 2 is a top plan view of the storage connector and rail of the invention.
Figure 3:
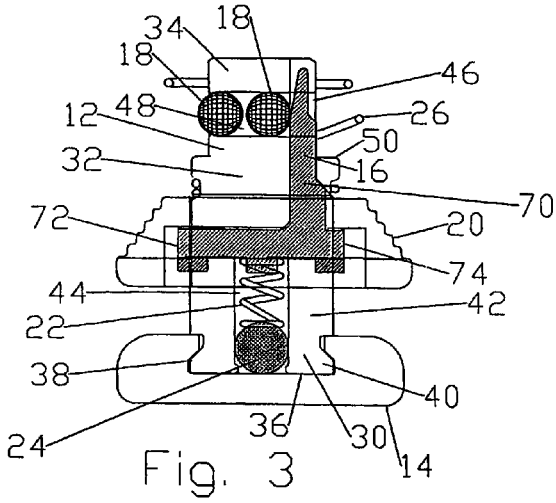
FIG. 3 is a sectional view of the storage connector and rail of the invention.
Figure 4:
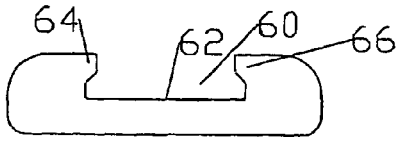
FIG. 4 is an elevational view of the rail of the invention.

A wrench socket retaining and releasing storage apparatus 10 has a body 12 that slidably fits on a rail 14. Slide key 16 positively locks the socket (not shown) in place by displacing lock balls 18 transversely. Manually actuated release sleeve 20 moves the slide key 16 against a lock spring 22 which both urges the slide key 16 upward, and urges tension ball 24 downward to engage rail 14. A tapered spiral ejector spring 26 both urges the socket off the end, and retains the entire lock portion of the assembly 10 together.

Body 12 has a base 30 on which is formed a shank 32 which leads to a square drive retaining end 34. Preferably body 12 is formed of a thermoplastic such as a nylon compound by injection molding. Precision, economy, resiliency and self lubrication are all advantageous properties of such a material. However other materials are hot precluded and may be advantageous in avionic environments, for example, in high temperature storage locations, such as an engine room.

Figure 6:
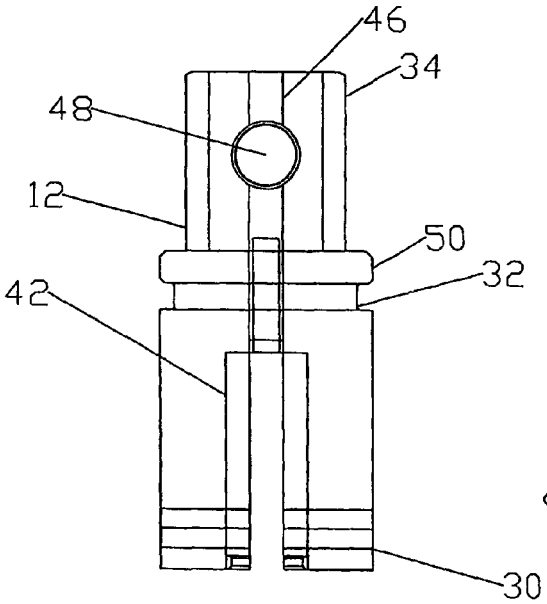
FIG. 6 is a rear elevational view of the body of the invention.
Figure 7:
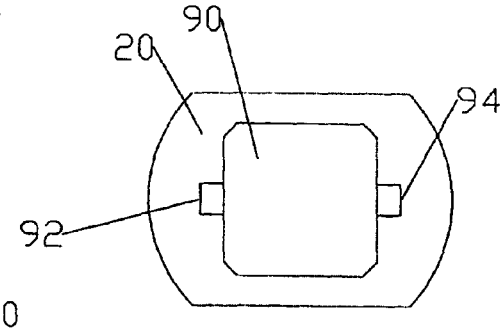
FIG. 7 is a bottom plan view of the sleeve of the invention.

Base 30 has a bottom surface 36 with beveled edges 38,40. Between edges 38,40 slot 42 passes entirely through base 30 on the center line and perpendicular to edges 38,40, as shown in FIG. 6. Body 12 has a vertical axis on its center and a cylindrical bore 44 extends up from surface 36 its height substantially the same as that of slot 44.

Extending upward from base 30 is channel 46. Channel 46 is recessed from the outer surfaces of the shank 32 of end 34. Transverse bore 48 intersects channel 46 and extends completely through the end 34 so as to operatively receive balls 18. The teachings in my above referenced U.S. patents describe the interaction of a control bar and retainer ball socket lock, the retainer balls there coacting with the control bar there in a manner similar to this invention's looking balls 18 and slide key 16. Collar 50 is formed on shank 32 and provides a location for spring 22 to anchor the entire assembly.

Rail 14 is preferably formed of an anodized aluminum extrusion. Other materials and forming methods may be suitable, such as plastics or other metals or forming methods such as bending, rolling, molding, costing or forging. Roll forming metal sheet, for example may be economical and functional. Rail 14 has groove 60 formed above a floor 62 and further defined by inwardly turning rims 64, 66. Rims 64, 66 are formed to correspond to edges 38, 40, with adequate clearance for easy manual movement, recognizing that friction for resisting unwanted movement will be added by the tension on spring 22 through tension ball 24 contacting floor 62. Slight downward manual pressure will reduce friction between rims 64, 66 and edges 38, 40, again with the components formed with clearance enabling this ease of movement.

Figure 5:
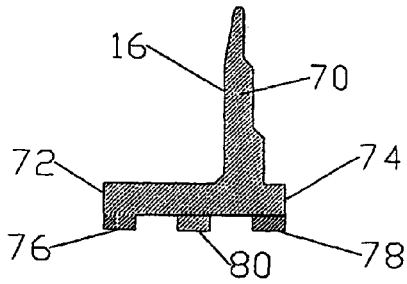
FIG. 5 is an elevational view of the key of the invention.

Slide key 16 is formed in a generally inverted "T" shape having an upwardly extending leg 70 and transversely extending arms 72, 74. The end ramp and shoulder of leg 70 operate in much the same way as the wedge locking socket drive extension of my U.S. Pat. No. 4,938,107 and its predecessors. Arms 72, 74 have downwardly depending ears 76, 78 and directly under leg 70 is downwardly depending tab 80. Ears provide stability, and enable the mechanism to bottom out with metal on metal contact, by contacting the top side of rims 64, 66. Tab 80 as shown in FIG. 5, retains spring 22 in position.

Manually actuated release sleeve 20 can be formed in a variety of shapes. As shown, a stepped pyramidal form is preferred. The pyramidal form provides adequate friction for finger manipulation yet also enables the molding of a pattern such as a tool company logo or trademark, without the loss in friction resulting from adding the logo pattern to a different shape, such as a lozenge shape. A square aperture 90 fits shank 32 and has sufficient clearance to enable the wedge-locking movement of leg 70. Notches 92, 94 receive arms 72, 74.

In operation a socket (not shown) will be placed on end 34 and pushed downward against spring 26 until ball 18 engages the socket retainer recess in the manner described in my other patents. Spring 26 is at all times retained by collar 50. Depressing sleeve 20 until ball 18 disengages the socket and spring 26 forces the socket upward. Sleeve 20 will depress no lower than permitted by ears 76, 78 contacting rims 64, 66, providing a backup for cases when wear or contamination make the spring releasing inoperative or imprecise. Lock spring 22 urges key 16 upwards and provides resistance to depressing sleeve 20.

A plurality of storage apparatuses 12 will be placed on a single rail 14 in the normal course and tension ball 24 coacting with spring 22, provide resistance to the longitudinal movement of the apparatuses 12 on the rail 14. Thus spring 22 performs two separate functions, urging the slide key 16 upward, and urging tension ball 24 downward to engage rail 14.

As previously mentioned, ejector spring 26 is formed as a tapered spiral, in that the top coil is of a larger diameter than the lower coil of the spring. This enables a larger area to contact the socket while the tighter lower coil can engage collar 50. The key 16 and balls 18 of the device can be manually disassembled by distortion of the spring and removal of the components. Use of a nylon type material enables the spreading of slot 42 enabling removal of ball 24 and spring 22.

The rail 14 has sufficient thickness to have a degree of inherent stability and to also permit mounting to a wall or a tool box by various fasteners such as rivets, clips, through bolts or tapped threaded fastener holes. Further, a variety of quick-release mechanisms can permit a rail to be securely fastened, yet easily removed.

While the present invention has been disclosed and described with reference to a single embodiment thereof, it will be apparent, as noted above that variations and modifications may be made therein. It is also noted that the present invention is independent of the tools or sockets being stored, and is not limited to the storage of a particular type of socket or tools. It is, thus, intended in the claims to cover each variation and modification that falls within the true spirit and scope of the present invention.

What is claimed is:

1. A drive member storage device for retaining ratchet wrench sockets comprising:

a rail;

a base portion adapted to be connected to the rail;

a post adapted to accept a drive member thereon, the post extending outwardly from the base portion;

a retention device associated with the post, the retention device adapted to retain the drive member to the post by mechanical engagement;

a release mechanism associated with the post and adapted to release the drive member from the post by disengaging the retention device;

a biasing member adapted to expel the drive member from the post when the release mechanism is depressed;

wherein the release mechanism includes a sleeve surrounding the base portion, the sleeve adapted to be urged toward the base portion to release the drive member.

2. The drive member storage device of claim 1, further including a slide key having a first leg and a second leg substantially perpendicular to the first leg.

3. The drive member storage device of claim 2, wherein the first leg of the slide key is adapted to displace a socket detent mechanism.

4. The drive member storage device of claim 3, wherein the second leg of the slide key is adapted to be connected to the sleeve, wherein depressing the sleeve moves the slide key.

5. The drive member storage device of claim 4, further including a biasing member adapted to bias the slide key away from the base portion.

6. A socket storage device for retaining ratchet wrench drive members comprising:

a base portion adapted to maintain the position of the socket storage device on a rail;

a post adapted to accept a drive member thereon, the post extending outwardly from the base portion;

a retention device associated with the post the retention device adapted to retain the drive member to the post by mechanical engagement;

a release mechanism associated with the post and adapted to release the drive member from the post by disengaging said retention device; and a biasing member adapted to expel the drive member from the post when the release mechanism is depressed;

wherein the release mechanism includes a sleeve associated with the base portion, the sleeve adapted to be depressed to release the drive member.

7. The drive member storage device of claim 6, where the device further includes a slide key associated with the post, the slide key having a first leg and a second leg substantially perpendicular to the first leg.

8. The drive member storage device of claim 7, wherein the first leg of the slide key is adapted to displace a socket detent mechanism.

9. The drive member storage device of claim 7, wherein the second leg of the slide key is adapted to be connected to the sleeve, wherein depressing the sleeve moves the slide key.

10. The drive member storage device of claim 6 further comprising a rail adapted to accept a plurality of base portions thereon.

11. The drive member storage device of claim 10, wherein the base portion includes a retention ball adapted to maintain the relative position of the base portion with respect to opposite ends of the rail.

12. A socket storage device for retaining ratchet wrench drive members comprising:

an elongated rail;

a plurality of drive member storage connectors, each adapted to accept and retain a drive member, said drive member storage connectors including a base portion adapted to be connected to the rail;

a post adapted to accept a drive member thereon, the post extending outwardly from the base portion;

a retention device associated with the post, the retention device adapted to retain the drive member to the post by mechanical engagement;

a release mechanism associated with the post and adapted to release the drive member from the post by disengaging the retention device;

a biasing member adapted to expel the drive member from the post when the release mechanism is depressed;

wherein the release mechanism includes a sleeve associated with the base portion, the sleeve adapted to be depressed to release the drive member.

13. The drive member storage device of claim 12 where the device further includes a slide key having a first leg and a second leg perpendicularly oriented to the first leg.

14. The drive member storage device of claim 13, wherein the first leg of the slide key is adapted to displace a socket detent mechanism.

15. The drive member storage device of claim 13, wherein the second leg of the slide key is adapted to be connected to the sleeve, wherein depressing the sleeve moves the slide key.

16. The drive member storage device of claim 13, wherein the base portion includes a rail detent mechanism adapted to aid in retaining the position of the socket storage connectors with respect to the rail.

17. The socket drive member device of claim 16, further comprising a spring having a first end in contact with the rail detent mechanism and a second end in contact with the slide key.

* * * * *